United States Patent [19]

Cahoon et al.

[11] Patent Number: 4,487,251

[45] Date of Patent: Dec. 11, 1984

[54] CONTINUOUS CASTING APPARATUS AND A METHOD OF USING THE SAME

[75] Inventors: John B. Cahoon, Riverside, Calif.; Mark K. Fishler, Pittsburgh, Pa.

[73] Assignee: Vesuvius Crucible Company, Pittsburgh, Pa.

[21] Appl. No.: 356,218

[22] Filed: Mar. 8, 1982

[51] Int. Cl.[3] ..... B22D 11/10

[52] U.S. Cl. ..... 164/475; 164/415; 164/437; 164/488; 222/603

[58] Field of Search ..... 164/453, 475, 488, 415, 164/437; 222/595, 602, 603

[56] References Cited

U.S. PATENT DOCUMENTS

| | | | |
|---|---|---|---|
| 3,253,307 | 5/1966 | Griffiths et al. | 222/591 X |
| 4,108,339 | 8/1978 | Lunde | 222/603 X |

FOREIGN PATENT DOCUMENTS

| | | | |
|---|---|---|---|
| 54-126631 | 10/1979 | Japan | 164/437 |
| 56-102357 | 8/1981 | Japan | 164/437 |
| 56-148453 | 11/1981 | Japan | 164/437 |

*Primary Examiner*—Nicholas P. Godici
*Assistant Examiner*—J. Reed Batten, Jr.
*Attorney, Agent, or Firm*—Reed, Smith, Shaw & McClay

[57] ABSTRACT

A nozzle is provided having an elongated conduit extending therethrough for delivering molten metal below the surface of a pool of molten material. The nozzle includes facilities for passing a fluid medium, e.g., argon, through its wall members transverse to the direction of molten metal flow into the elongated conduit to retard the accumulation of undesirable formations, e.g., metal oxides, on the inner wall surfaces of the conduit during molten metal flow. In a first embodiment, gas permeable wall members define portions of the conduit through which the fluid medium percolates. In a second embodiment, a plurality of small ports are provided in the wall members defining the conduit through which the fluid medium is emitted in the conduit. Preferably, the nozzle also includes a base portion that directs the molten metal flow in an upwardly direction and which has facilities for retarding the accumulation of undesirable formations thereon.

8 Claims, 12 Drawing Figures

CONTINUOUS CASTING APPARATUS AND A METHOD OF USING THE SAME

FIELD OF THE INVENTION

The present invention relates to continuous casting apparatus for progressively forming an elongated casting from molten material and more particularly, to delivery facilities used in continuous casting techniques.

BACKGROUND OF THE INVENTION

Continuous casting of steel and other metals is well known in the art. Typically, a nozzle (called a "subentry nozzle") is employed to deliver the molten metal from a tundish into a continuous casting mold below the surface of the body of molten metal adjacent the upper portion of the mold. Entry of the molten steel from the tundish into the upper end of the nozzle is controlled by a stopper-rod which seals and closes the entrance to the nozzle. Means are provided for moving the stopper-rod vertically. As the stopper-rod is moved upwardly away from the nozzle, the molten metal flows into the nozzle through the annular space formed between the stopper-rod and the upper end of the nozzle.

The nozzle typically has a flow rate substantially greater than the optimum casting rate of the apparatus, and the casting rate of the apparatus is controlled by regulating the distance of the stopper-rod from the upper end of the nozzle. The cross-sectional area of the nozzle in some instances approaches twice the cross-sectional area needed for the optimum casting rate. Large bore nozzles (80–90 mm) casting typically aluminum-killed steels have, however, experienced aluminum oxide accumulation under the stopper-rod which restricted and closed-off the flow of molten metal. The accumulation of aluminum oxide may be minimized by introducing an inert gas, such as argon or nitrogen, into the upper end of the nozzle through an orifice in the stopper-rod, but this technique fails to prevent aluminum oxide accumulation in the lower part of the nozzle where the molten metal flows out the nozzle into the mold. See U.S. Pat. Nos. 3,886,992, 3,888,294 and 3,935,895.

Various shrouds and nozzles have been proposed for retarding oxidation of the molten metal during casting. Illustrative of the art is believed to be the disclosures of U.S. Pat. Nos. 2,005,311, 2,503,819, 3,208,117, 3,439,735 3,608,621, 3,746,077, 3,886,992, 3,888,294, 3,908,735 and 3,935,895, French Pat. Nos. 1,542,950 and 1,586,666, and Dutch Pat. No. 228,418. The most pertinent of the prior disclosures is believed to be U.S. Pat. Nos. 3,886,992, 3,888,294, and 3,935,895, mentioned above, and U.S. Pat. Nos. 3,439,735, 3,451,594, and 3,608,621.

U.S. Pat. No. 3,451,594 is directed to a tundish nozzle which has a series of apertures about its lower extremity directed parallel to the nozzle opening. As an uncontained stream of molten steel passes between the bottom opening of the tundish nozzle and the mold cavity, inert gas is ejected from the apertures around the opening parallel to the molten stream to form a curtain completely enveloping the molten stream so as to prevent the formation of spinels, such as iron oxide-aluminum oxide.

U.S. Pat. No. 3,608,621 discloses a method for controlling the flow of molten metal from a tundish into a continuous casting mold by regulating a gas supply to the apparatus as a function of the level of molten metal in the casting mold. The apparatus has a casting tube mounted in the tundish and extending through the bottom of the tundish, with its upper, open end extending upwardly from the bottom of the tundish to a height above the normal level of molten metal in the tundish. A rising tube is concentrically positioned around the casting tube with its upper end extending above the upper end of the casting tube and its lower end having openings through which molten metal in the tundish can flow into the space between the tubes. The molten metal is caused to rise in the space between the tubes by a controlled supply of gas, such as argon, to the molten metal in the lower part of the space between the tubes to mix with the molten metal and cause the molten metal to rise up and overflow into the casting tube in a controlled flow.

U.S. Pat. No. 3,439,735 describes a stream protector which surrounds in non-contacting relation a free-falling stream of molten metal, for retarding the atmospheric contamination of the molten metal as it is teemed from a tundish to a mold. A pair of annular gas channels separated by baffles are placed at the upper extremity of the protector near the input port of the molten metal to project a cylindrical curtain of inert gas around the free-falling stream of molten metal. It is expected, however, that the lower portion of the protector is subject to metal oxide deposits as the inner surface of the protector becomes more distant from the gas channels.

The present invention overcomes these disadvantages and difficulties. It provides a nozzle for delivering molten metal from a tundish below the surface of a body of molten material in a continuous casting apparatus while inhibiting the formation of aluminum oxide and the like in the lower discharge portion of the nozzle.

SUMMARY OF THE INVENTION

A nozzle is provided for delivering a flow of molten material below the surface of a body of molten material, and particularly for delivering a flow of molten metal from a tundish below the surface of a body of molten metal contained in a continuous casting mold.

The nozzle includes an elongated member having a molten material conduit extending therethrough for delivering a flow of molten material to below the surface of a body of molten material and facilities for passing a selected fluid medium through the inner wall surfaces which define the molten material conduit adjacent at least the downstream end thereof to retard the accumulation of undesirable formations on the inner wall surfaces. The nozzle may include an internal passageway formed within its wall members and having an inlet port through which the selected fluid medium may be passed. In a first embodiment of the invention, fluid-permeable portions are provided between the internal passageway and the molten material conduit through which the selected fluid medium may pass. In an alternative embodiment, a plurality of outlet ports are provided in the inner wall surfaces to pass the selected fluid medium from the internal passageway to the molten material conduit. Preferably the nozzle also includes a base portion which diverts the flow of molten material from below the surface of the body of molten material toward the surface of the body of molten material.

BRIEF DESCRIPTION OF THE DRAWINGS

In the accompanying drawings, the presently preferred embodiments of the invention are shown, in which.

DESCRIPTION OF THE PREFERRED EMBODIMENTS

Figure 1:
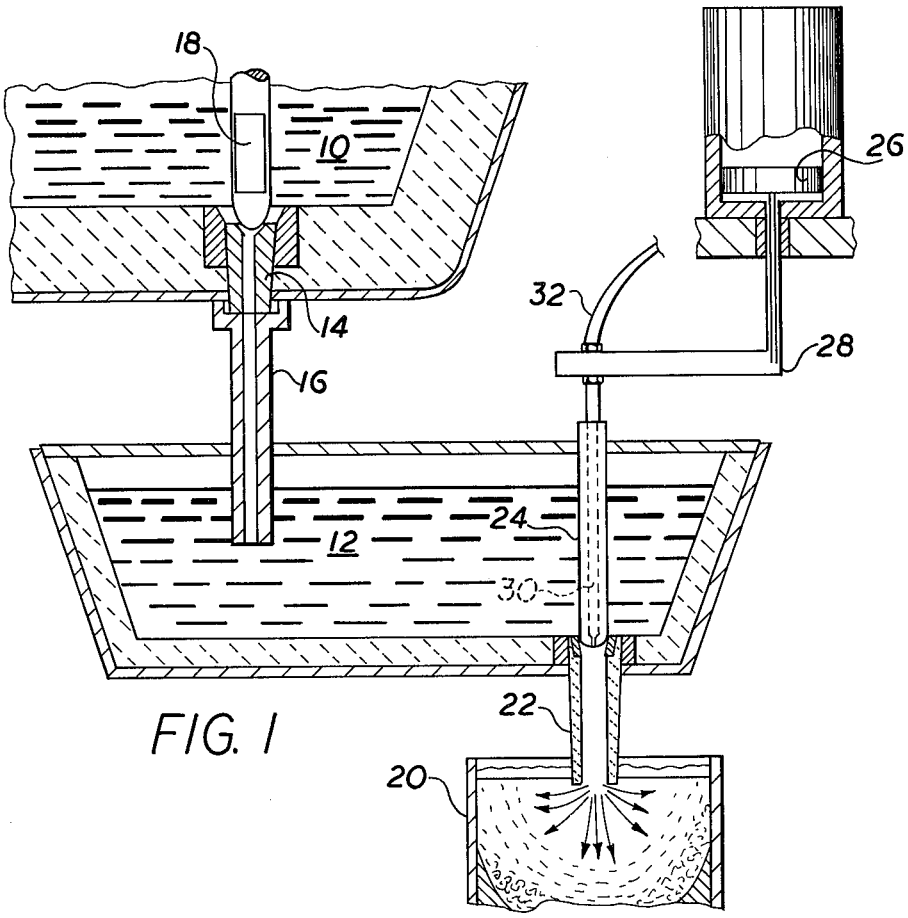
FIG. 1 is a partial elevational view in cross-section of a continuous casting system, including a nozzle for delivering molten material below the surface of a body of molten material.

FIG. 1 shows a typical application of a nozzle for delivering molten material below the surface of a body of molten material in a typical continuous casting steelmaking operation. In FIG. 1, molten steel contained in a conventional refractory lined ladle 10 is teemed from ladle 10 to a tundish 12 through nozzle 14 and shroud 16. The flow of the molten metal from ladle 10 to tundish 12 is controlled by regulating the position of a ladle stopper 18 in relation to the entry orifice of nozzle 14. The molten metal in tundish 12 is then delivered into continuous casting mold 20 through a nozzle 22, which is more particularly described hereinafter.

On introduction into continuous casting mold 20, the metal solidifies as it flows through the mold away from the upper portion of the mold, with the outer portions of the body of metal solidifying first to form a shell. The molten metal in the interior of the mold is retained within this shell even after the steel exits from the casting mold 20, until it is sufficiently cooled to completely solidify. Accordingly, it is apparent that the rate of flow of the body of metal through continuous casting mold 20 and the removal of impurities from the steel before solidification are critical.

As further shown in FIG. 1, the rate at which the steel is delivered from tundish 12 to continuous casting mold 20 is controlled by the position of a stopper rod 24. The regulation of the position of stopper rod 24 is accomplished in FIG. 1 by a control mechanism which includes piston 26 and control rod 28, although it will be apparent that other control mechanisms would also be suitable. Stopper rod 24 includes conduit 30 as shown in FIG. 1 in dashed lines. A gas such as argon or nitrogen, which is substantially inert to the molten metal, is provided at the inlet orifice of nozzle 22, as the molten metal flows through the nozzle, to retard formation and accumulation of metal oxides in the upper portion of nozzle 22.

As shown more clearly in FIGS. 2 and 3, nozzle 22 includes a tubular member 34 for delivering the flow of molten material downwardly to a level below the upper surface of the molten material in continuous casting mold 20. Tubular member 34 supports a refractory seal or insert 35, which is disposed in sealing relationship between tundish stopper 24 and tubular member 34 when tundish stopper 24 is in the closed position.

Tubular member 34 includes in inner part 33 adjacent the inner surface 37 thereof which is made of a permeable material capable of passing a selected fluid, e.g., a gas such as argon or nitrogen that is inert to the molten metal. Tubular member 34 also includes an internal passageway 32 located in its wall member which serves to conduct the selected fluid from an inlet port 36 to inner part 33 where it percolates through inner part 33 to retard the accumulation of material, such as aluminum oxide, on the inner surface 37 of the tubular member 34 as the flow of molten material is delivered downwardly through the tubular member 34.

Preferably, internal passageway 32 comprises a cylindrical conduit which extends along the lower region of nozzle 22. Sufficient pressure is maintained in passageway 32 that the selected fluid percolates through inner part 33 of tubular member 34 between internal passageway 32 and inner surface portions 37 to retard the accumulation of aluminum oxide deposits on surface portions 37 in the lower region of nozzle 22 as the flow of molten material is delivered downwardly through tubular member 34.

Tubular member 34 and inner part 33 are typically made integrally as a singular unit by a pressing technique using an appropriate mold. The inner part 33 and outer part of tubular member 34 may, however, be separately made and assembled. In either fabrication method the tubular member 34 and inner part 33 may be formed of the same or different materials. Tubular member 34 and inner part 33 are usually a refractory material such as alumina graphite, zirconia, or alumina that is sufficiently strong to withstand the thermal stresses exerted on it, while having a porosity such that it is permeable to the selected fluid. The selected refractory material for inner part 33 generally has a porosity in the range of 12–30% and most desirably in the range of 16–19% by volume, as measured by comparing the volume of open pores to the exterior volume of the material. Inner part 33 generally has a thickness between about 0.20 inch (0.5 cm.) and 0.80 inch (2 cm.), and tubular member 34 may have a thickness between about 0.60 inch (1.5 cm.) and 1.5 inch (4 cm.).

Referring to FIGS. 4–7, a second embodiment of a nozzle is shown for delivering molten material below the surface of a body of molten material. The nozzle 40 is the same as above described in connection with FIGS. 1–3 with the additions and variants described below.

The nozzle 40 includes a base portion 48 adjacent lower end portions 50 of a tubular member 52 and an inner part 53, with wall portions 54 extending upwardly from the base portion 48 of nozzle 40. Wall portions 54 thicken adjacent base portion 48 to divert the flow of molten material through lateral outlet ports 60 and 62 at an acute angle to the direction of the flow of material through tubular member 52. Base portion 48 and wall portions 54 of nozzle 40 control the circulation of the molten metal in the upper regions of the metal body within casting mold 20 such that flows from the nozzle 40 are directed toward the surface of the metal body in mold 20, where impurities in the molten metal are accumulated in a layer of slag.

Figure 4:
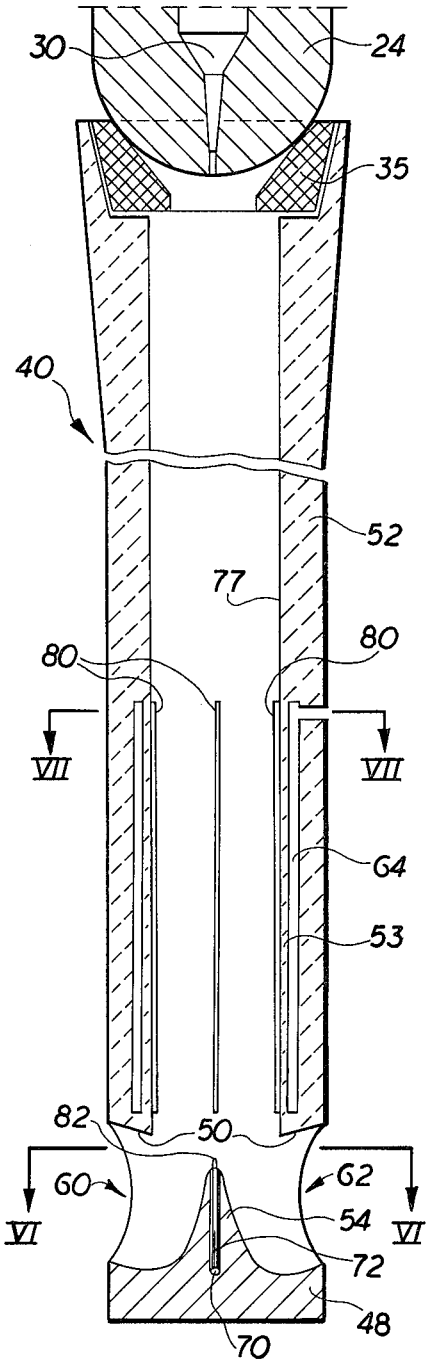
FIG. 4 is an elevational view in cross-section of a second embodiment of a nozzle for delivering molten material below the surface of a body of molten material.
Figure 5:
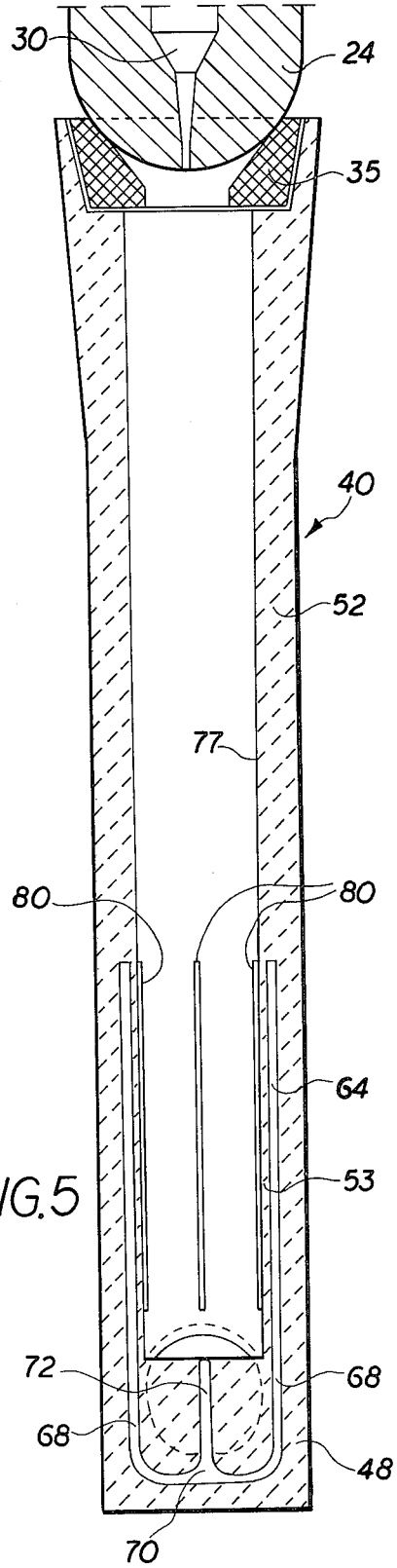
FIG. 5 is an elevational view in cross-section of the nozzle shown in FIG. 4 taken at right angle to the view shown in FIG. 4.
Figure 6:
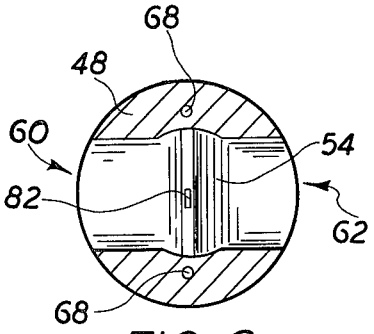
FIG. 6 is a cross-sectional view taken along line VI—VI of FIG. 4.
Figure 7:
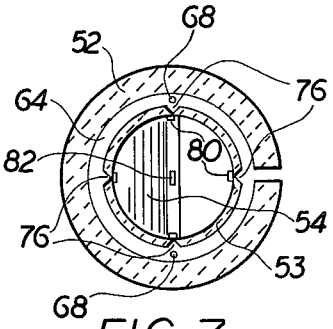
FIG. 7 is a cross-sectional view taken along line VII—VII of FIG. 4.

As best shown in FIGS. 4 and 5, passageway 64 extends into base portion 48 adjacent wall portions 54. Preferably, passageway 64 includes conduit portions 68 which extend downwardly into base portion 48 and meet to join to form junction 70 and output branch 72.

Figure 2:
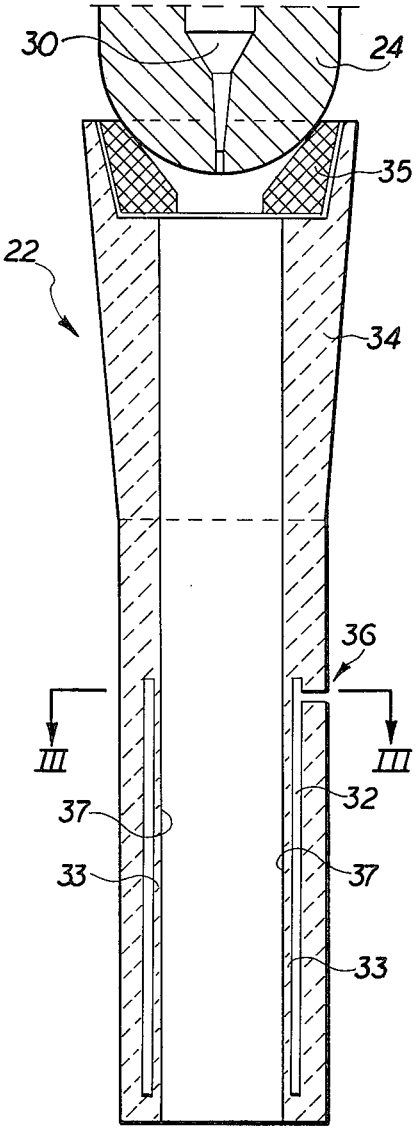
FIG. 2 is an enlarged elevational sectional view of a nozzle shown in FIG. 1.
Figure 3:
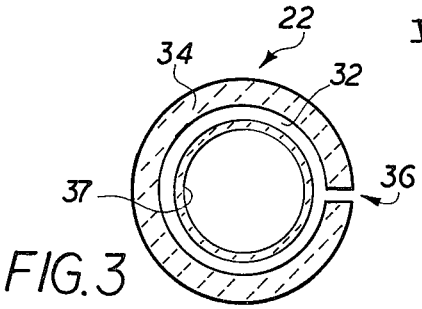
FIG. 3 is a cross-sectional view taken along line III—III of FIG. 2.

Base portion 48 and wall portions 54 may be fabricated of porous material similar to that previously described with respect to the inner part 33 of tubular member 34 of FIGS. 1–3 and inert gas may be conducted through conduits 68, 70 and 72 to percolate through wall portion 54 to retard metal oxide accumulations on the wall portion 54.

Alternatively and with continued reference to the nozzle 40 shown in FIGS. 4–7, the passageway 64 may include notched segments 76 (shown only in FIG. 7), disposed at selected radial positions around passageway 64 and inner part 53. The notched segments 76 extend vertically along the inner part 53 of tubular member 52. Over notched segments 76 at inner surface portions 77 of the lower portions of the inner part 53 are provided porous strips 80 through which fluid from passageway 64 can percolate to retard the formation of metal oxides and other material on inner surface portion 77. The thin strips 80 are preferably between about 0.15 inch (0.3 cm.) in thickness and may be formed of a porous material having a porosity of about 12 to 30% and most desirably 20 to 30% by volume, e.g., a gap-grained aluminum oxide material.

Similarly, output branch 72 be extended in wall portions 54 to provide a small aperture therein which may be covered by a section of porous material 82, similar to porous strips 80. Fluid from conduit portions 68 can thus percolate through porous section 82 and retard accumulation of metal oxides on wall portions 54.

In this embodiment of the invention tubular member 52, inner part 53, and base portion 48 can be made of non-porous material or porous material without regard to its permeability to fluid. The percolation of the fluid to retard formation of material on the inner surface portions while molten metal is delivered downwardly through the nozzle 40 is provided by porous strips 80 and porous section 82.

Figure 8:
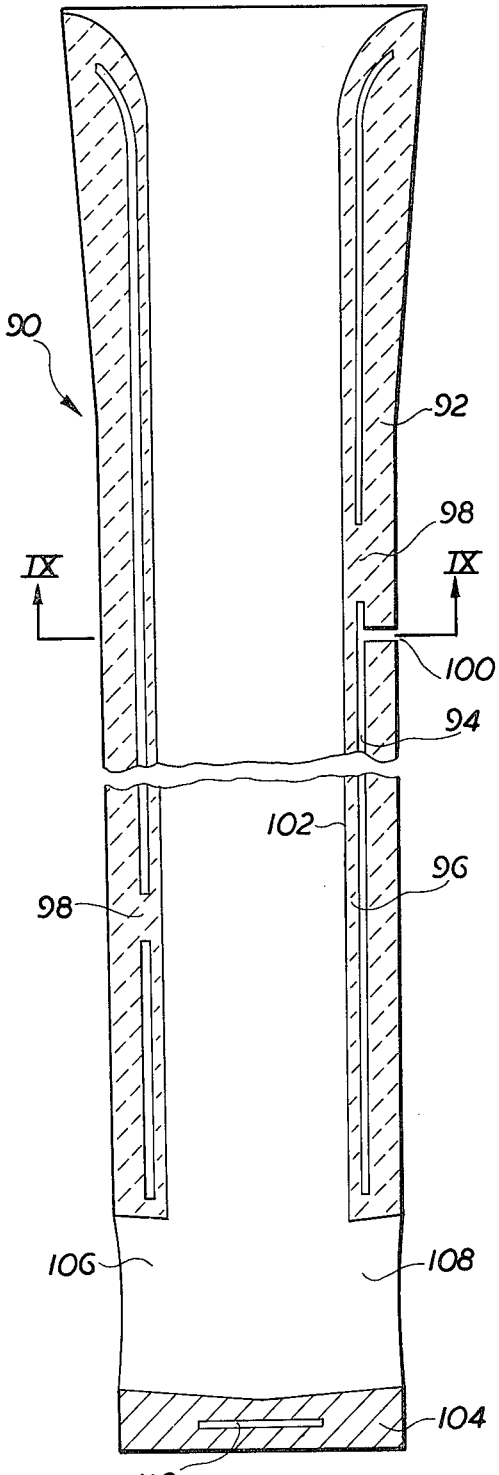
FIG. 8 is an elevational view in cross-section of a third embodiment of a nozzle for delivering molten material below the surface of a body of molten material.
Figure 9:
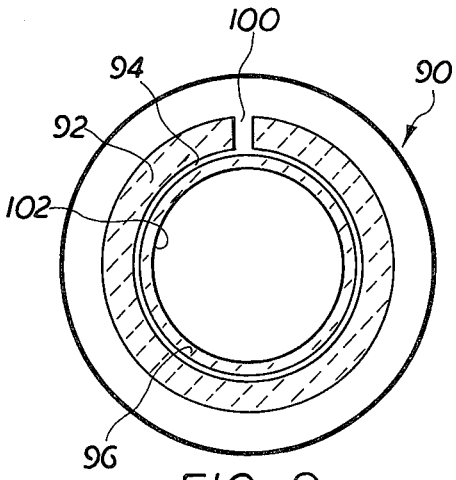
FIG. 9 is a cross-sectional view taken along line IX—IX of FIG. 8.
Figure 10:
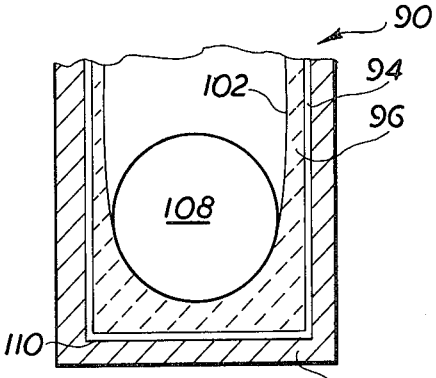
FIG. 10 is a fragmentary elevational view in cross-section of the lower portion of the nozzle shown in FIG. 8 taken at right angle to the view shown in FIG. 8.

Referring to FIGS. 8–10, a third embodiment of a nozzle is shown for delivering molten material below the surface of a body of molten material such as in continuous casting mold. The nozzle 90 is similar to the nozzle 40 described in connection with FIGS. 4–7 with the additions and variants described below.

The nozzle 90 as shown in FIGS. 8–10 has no refractory seal disposed between stopper 24 and the tubular member 92. Instead, the contour of tubular member 92 is flared at its upper extremity to accommodate the bottom of stopper 24 such that stopper 24 rests directly upon tubular member 92 to form a seal therebetween.

A passageway 94 is provided of a generally cylindrical shape which may extend substantially the entire length of tubular member 92 adjacent an inner part 96 of the tubular member 92. Tubular member 92 includes bridge segments 98 to span the radial dimension of passageway 94 to provide structural support for inner part 96 of the tubular member. Inner part 96 is formed of a porous material such that when a selected fluid is introduced to passageway 94 through input port 100 at sufficient pressure, the fluid is percolated through inner part 96 of tubular member 92 to the inner surface portions 102 thereof. This percolation retards the accumulation of metal oxides throughout both upper and lower regions of the inner surface 102 of tubular member 92.

Nozzle 90 additionally includes a base portion 104. Base portion 104 may be formed of the same porous material as tubular member 92. Base portion 104 extends from lower portions of tubular member 92 to divert the downward flow of molten metal outwardly through lateral output ports 106 and 108 at a direction which is acute to the downward flow of molten metal through the tubular member 92. Passageway 110 extends from passageway 94 through base portion 104 so that fluid from passageway 94 is conducted into passageway 110 to percolate through base portion 104 at the inner wall portions thereof. The accumulation of metal oxides on the inner wall portions is thus retarded during the delivery of molten metal downwardly through the nozzle 90.

Figure 11:
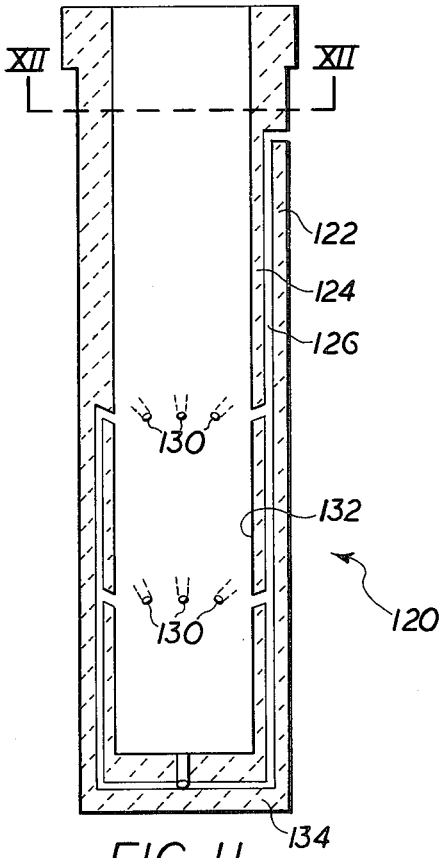
FIG. 11 is an elevational view in cross-section of a fourth embodiment of a nozzle for delivering molten material below the surface of a body of molten material.
Figure 12:
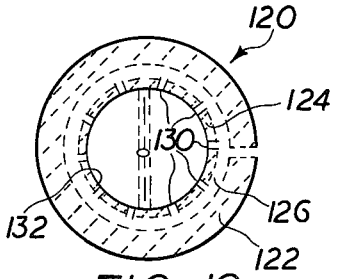
FIG. 12 is a cross-sectional view taken along line XII—XII of FIG. 11.

Referring to FIGS. 11 and 12, a fourth embodiment of a nozzle is shown for delivering molten material below the surface of a body of molten material such as in a continuous casting mold. The nozzle 120 is similar to the nozzle 90 described in connection with FIGS. 8-10 with the additions and variants described below.

The nozzle 120 includes a tubular member 122 and an inner part 124 separated by an internal passageway 126. The internal passageway 126 includes a plurality of ports 130 extending therefrom to the inner surface 132 of the inner part 124, through which a supply of inert gas is passed to protect the inner surface 132 from undesirable metal oxide accumulations. The nozzle 120 may include a base portion 134 which redirects the flow of molten metal. The ports 130 may be oriented radially about the inner surface 132 as shown in FIG. 11, or may be oriented in any other convenient fashion. Additionally, the ports 130 may be downwardly angled into the flow of molten metal, both to minimize the ingress of molten metal thereinto, and also to facilitate the admixture of the inert gas with the molten metal. The selected size and angular orientation of the ports 130 is not limiting to the present invention, each being alterable in accordance with such variables as the molten metal flow rate and the gas pressure selected. In one embodiment ports 130 are between about 0.08 inch (0.2 cm.) and 0.2 inch (0.5 cm.), and most desirably about 0.12 inch (0.3 cm.) in diameter, with a line pressure of about 6 p.s.i. for the introduction of the inert gas to the passage 126.

Of course, it will be appreciated that the present invention is not intended to be limited to the particular embodiments disclosed herein, but rather, only by the claims which follow.

What is claimed is:

1. A nozzle for delivering molten material below the surface of a body of molten material, comprising:

an elongated member having wall members and a molten material conduit defined by inner wall surfaces of said wall members extending from a first end to a second end thereof for deliverying a flow of molten material from said first end to said second end below the surface of said body of molten material;

a base portion adjacent said second end of said elongated member and having inner surface portions exposed to said molten material and adapted for diverting the direction of molten material flow from that established in said conduit; and means for passing a selected fluid medium through said inner wall surfaces of said elongated member and said inner surface portions of said base portion toward and transverse to the direction of flow of molten material therealong to retard the accumulation of undesirable formations on said inner wall surfaces and inner surface portions during the flow of molten material therealong.

2. The nozzle as set forth in claim 1, wherein said medium passing means comprises:

an internal passageway formed within said wall members and extending into said base portion, said internal passageway including an inlet port adjacent the exterior surface of said wall members;

means for passing said selected fluid medium through said inlet port into said internal passageway; and fluid permeable portions in said elongated member and said base portion between said internal passageway and the molten material flow path to permit said fluid medium to pass therebetween.

3. The nozzle as set forth in claim 2, wherein said fluid-permeable portions have a porosity to said selected fluid medium of between about 12 percent and 30 percent by volume.

4. The nozzle as set forth in claim 3, wherein said fluid-permeable portions are formed of a ceramic material selected from the group consisting of alumina graphite, zirconia and aluminum oxide.

5. The nozzle as set forth in claim 2, wherein said fluid permeable portions comprise a plurality of outlet ports between said internal passageway and the molten material flow path.

6. A subentry nozzle for conducting a molten metal from a tundish into a continuous casting mold comprising:

a gas permeable tubular member for carrying a vertical stream of molten metal from a tundish into a continuous casting mold, said tubular member extending from the tundish and having lateral output ports located at lower end portions, said lateral output ports being disposed below the level of molten metal in said mold;

a base portion for diverting the vertical stream of molten metal through said lateral output ports; and gas passageways located internally within said gas permeable tubular member and extending into said base portion, said passageways conducting a gas through inner surface portions of said tubular member and said base portion to retard metal oxide accumulations on said inner surface portions as molten metal is delivered to said mold through the tubular member.

7. A method of delivering molten material below the surface of a body of molten material comprising the steps of:

A. proviing a tubular member having a molten material conduit therethrough with porous inner wall portions for delivering a flow of molten material downwardly to below an upper surface of a body of molten material and a base portion for diverting the direction of flow of said molten material at the lower end of said conduit, said tubular member and said base portion having porous inner wall portions;

B. passing a selected fluid medium through a passageway formed in wall members of said tubular member and base portion to said porous inner wall portions; and C. percolating said selected fluid medium through said porous inner wall portions of said tubular member and said base portion to retard accumulation of material on the molten material conduit and said base portion as said flow of molten material is delivered downwardly through said tubular member.

8. The method as set forth in claim 7, wherein said selected fluid medium is an inert gas.

* * * * *